United States Patent [19]

Kimura et al.

[11] Patent Number: 4,508,322

[45] Date of Patent: Apr. 2, 1985

[54] APPARATUS FOR PREPARING HIGH MELTING POINT HIGH TOUGHNESS METALS

[75] Inventors: Etsuji Kimura; Katsumi Ogi; Kazusuke Sato, all of Saitama, Japan

[73] Assignee: Mitsubishi Kinzoku Kabushiki Kaisha, Tokyo, Japan

[21] Appl. No.: 580,743

[22] Filed: Feb. 16, 1984

[30] Foreign Application Priority Data

Apr. 27, 1983 [JP] Japan ..... 58-072926

[51] Int. Cl.[3] ..... F27B 5/04

[52] U.S. Cl. ..... 266/149; 75/84.5; 266/905

[58] Field of Search ..... 266/149, 905; 75/84.5, 75/10 R

[56] References Cited

U.S. PATENT DOCUMENTS 4,403,769 9/1983 Ishizuka ..... 266/149

4,447,045 5/1984 Kimura et al. ..... 266/149

*Primary Examiner*—M. J. Andrews

*Attorney, Agent, or Firm*—Oblon, Fisher, Spivak, McClelland & Maier

[57] ABSTRACT

A hermetically closable and evacuable apparatus for preparing high melting point high toughness metals by reduction of a chloride of said metals comprising a heatable reaction chamber and a coolable condensation chamber provided above the reaction chamber which chambers communicate with each other through an intermediate connecting section, wherein the intermediate connecting section is provided with a seal pot closing means comprising a funnel body and a pan which can be opened to form a wide gas passage, is disclosed.

10 Claims, 6 Drawing Figures

APPARATUS FOR PREPARING HIGH MELTING POINT HIGH TOUGHNESS METALS

TECHNICAL FIELD OF THE INVENTION

This invention relates to an apparatus for reduction of metal chlorides. Among metallic materials, titanium and zirconium, which have high melting point and high toughness, are produced mainly by reduction of a chloride thereof with magnesium and obtained in the form of metal sponge.

BACKGROUND OF THE INVENTION

For the production of these high melting point high toughness metals, a hermetically closable and evacuable apparatus comprising a heatable reaction chamber and a coolable condensation chamber provided above the reaction chamber communicating each other with an intermediate connecting section is used, and magnesium and a chloride of said metals (titanium tetrachloride, for instance) are reacted in the reaction chamber, the formed magnesium chloride and unreacted magnesium are removed from the formed sponge metal by vacuum distillation, and the magnesium chloride and the magnesium are recovered in the cooled condensation chamber.

Such an apparatus is disclosed in Japanese Laying-Open Patent Publication No. 18717/72, for instance. In the apparatus of this kind, a problem arises concerning how to close the passage between the reaction chamber underneath and the condensation chamber above. In the apparatus disclosed in said patent publication, the passage of the intermediate connecting section is closed by a lid. But the mechanism of the lid is complicated and the lid is exposed to hot vapors of magnesium and magnesium chloride which pass within the proximity of said lid. Thus the lid is deformed by thermal strain and gradually fails to provide gas-tight closure.

A partially improved apparatus of this type is disclosed in Japanese Laying-Open Patent Publication No. 49922/77. In this apparatus, a lid of fusible metal such as magnesium, aluminum, zinc, or antimony is fixed by bolts so as to close the passage during the reduction reaction, and the lid is melted by a heating means at the stage of vacuum separation so as to open the connecting passage. The defect of the above-mentioned apparatus is eliminated by this improvement. But the apparatus is not quite satisfactory since a lid of a fusible metal, the surface of which is smoothly finished, has to be prepared for every run.

Both of the two above-cited apparatuses must be hoisted as a whole by a crane or the like for removal from the heating furnace and transfer to another position, since the two chambers cannot be separated at high temperature. This inconvenience will become even greater now that larger and larger apparatuses are being employed, since cranes with larger capacities and more spacious plant buildings will be required and construction cost will increase. This invention is intended to improve the efficiency of the above-mentioned apparatus overcoming the defects of prior art apparatuses by employing a seal pot structure as the means for closing the passage of the intermediate connecting section in an apparatus for reducing chlorides of high melting point high toughness metals comprising a reaction chamber and a condensation chamber connected by an intermediate connecting section.

We previously proposed an apparatus for producing high melting point high toughness metals by reduction of chloride thereof with an active metal which comprises a heatable reaction chamber in which the chloride and the active metal are reacted, an evacuable and coolable condensation chamber in which the active metal and the formed chloride which have been separated from the formed metal by evaporation in the reaction chamber are condensed, and an intermediate connecting section for communicating or cutting off the two chambers. The apparatus is characterized in that the intermediate connecting section is provided with a seal pot comprising a funnel body and a pan which receives the lower pipe of the funnel body and retains a fusible and vaporizable material and a heating means for melting and vaporizing the fusible and vaporizable material. (Japanese Laying-Open Patent Publication No. 126936/83 (Patent Application No. 8771/82))

However, this apparatus has a defect that the seal pot structure constitutes a high resistance to the flow of gases in comparison with the other parts when the apparatus is evacuated. The present invention has eliminated this defect.

DISCLOSURE OF THE INVENTION

This invention provides in a hermetically closable and evacuable apparatus for preparing high melting point high toughness metals by reduction of a chloride of said metals comprising a heatable reaction chamber and a coolable condensation chamber provided above the reaction chamber and communicating with the condensation chamber through an intermediate connecting section, the improved apparatus characterized in that said intermediate connecting section is provided with a seal pot closing means comprising an upright funnel body which has an opening of a substantial size and is supported by the internal wall of the intermediate connecting section at its periphery; a pan which can receive a fusible material therein and is pivotable around a rotation shaft secured thereto at one end thereof between a receiving position and a pouring position and receives the lower pipe of the funnel body when it is at the receiving position; and a heating means for heating the seal pot.

This invention also provides in a hermetically closable and evacuable apparatus for preparing high melting point high toughness metal by reduction of a chloride of said metals comprising a heatable reaction chamber and a coolable condensation chamber provided above the reaction chamber and communicating with the condensation chamber through an intermediate connecting section, the improved apparatus characterized in that said intermediate connecting section is provided with a seal pot closing means comprising an inverted funnel body which has an opening of a substantial size and is supported by the internal wall of the intermediate connecting section at its periphery, and can receive a fusible material in the space formed by the funnel and the internal wall of the intermediate connecting section; a pan which covers the opening of the funnel and is pivotable around a rotation shaft secured thereto at one end thereof; and a heating means for heating the seal pot.

In this specification, the term "funnel body" means a shape comprising a pan-like part or conical part and a cylindrical part communicating with said pan-like part or conical part.

In the apparatus of this invention, the seal pot part can be widely opened. Therefore, the resistance to gas flow at the time of evacuation is remarkably reduced, the operation time is shortened, and the quality of the produced sponge metal is improved.

The term "seal pot" used in this specification means a seal pot of the conventional structure, but it is different therefrom in that fusible but normally solid materials are used as the sealant. Sealants usable in this invention include low-melting metals such as magnesium, aluminum, zinc, antimony; and salts such as magnesium chloride, sodium chloride, potassium chloride and mixtures thereof. But metals are preferred since perfect sealing is possible and, inter alia, magnesium is most preferred since it does not contaminate the produced high melting point high toughness metals.

This invention provides an apparatus for reduction of chlorides of high melting high toughness metals which is more convenient to use than the known apparatuses of the same type. Today, this apparatus can be used for production of titanium and zirconium. However, those skilled in the art will find uses for this apparatus if processes for production of similar metals by reduction of chlorides thereof with an active metal (sodium, calcium, etc., as well as magnesium) are developed.

Now the invention will be explained in detail with respect to preferred embodiments with reference to the attached drawings.

DETAILED DESCRIPTION OF THE INVENTION

Figure 1:
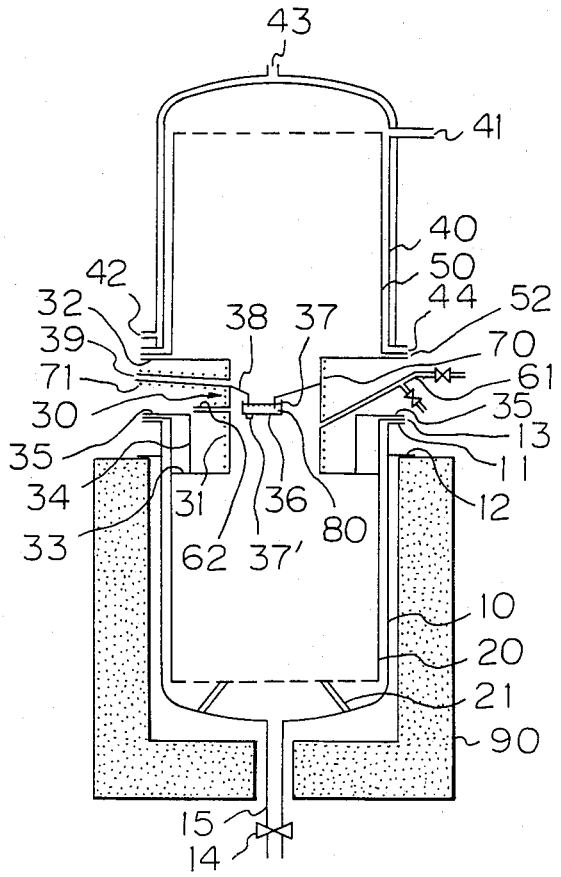
FIG. 1 is a schematic representation of the known apparatus to which this invention is applied.

FIG. 1 is an elevational cross section of an embodiment of this invention. A reaction chamber comprises an external container or a reaction retort 10 and an internal container 20 received in the former supported by leg members 21.

The retort 10 can be of any shape, but practically it is cylindrical and the internal container 20 is also cylindrical and a little smaller than the former. The bottom of the internal container 20 is provided with at least one perforation for draining molten magnesium chloride, and the bottom of the retort 10 is provided with an outlet duct 15 having a valve means 14 for discharge of magnesium chloride. A flange 11 is formed at the upper periphery of the retort 10 and a supporting brim 12 is provided for supporting the retort 10 in a heating furnace 90 which is explained later.

An intermediate connecting section 30 is essentially a cylindrical body 31 having a diameter smaller than that of the internal container 20 of the reaction chamber. A large flange 32 extends from the upper periphery of the cylindrical body, a brim 33 extends from the lower periphery thereof, a cylindrical wall 34 is formed extending upward from the middle of the latter, but is shorter than the cylindrical body 31, and from the upper periphery thereof a flange 35 extends. The flange 35 is formed so that it can be placed upon the flange 13 of the internal container 20 and the flange 11 of the retort 10. The diameter of the brim 33 at the lower end of the intermediate connecting section is slightly smaller than the inside diameter of the internal container 20, whereby with which the brim may contact the internal wall of the intermediate connecting section.

The flange 35 of the intermediate connecting section 30, the flange 13 of the internal container 20 and the flange 11 of the retort are placed one over the other with gaskets inserted therebetween and detachably secured by means of bolts or clamps. Any known heat-resistive elastomer gasket can be used.

The condensation chamber comprises a jacketed cooling container 40 similar to the reaction retort in shape and a condensation cylinder 50 contained in the former. The cooling container 40 is provided with an exhaust outlet 41, an inlet 42 and an outlet 43 for the coolant (water), and a flange 44 is provided at the bottom thereof like that of the retort. The condensation cylinder 50 is a container a little smaller than the cooling container, the ceiling of which is provided with at least one perforation for allowing passage of gas. The lower periphery has a flange 52 like that of the cooling container. The flanges 32 of the intermediate connecting section 31 and the flanges 44 and 52 of the cooling container 40 and the condensation cylinder 50 are laid one over another with gaskets inserted therebetween and secured together by means of bolts or clamps. Here again, any known elastomer gasket can be used as well.

A funnel body 38 is provided in the central part of the cylindrical body 31 of the intermediate connecting section 30. The upper periphery of the funnel body 38 is hermetically secured to the inside wall of the cylindrical body 31 and the lower pipe thereof is received in a shallow cylindrical pan 36. The detail of the structure of the seal pot comprising the funnel body and the pan will be explained later.

Usually the intermediate connecting section 30 is provided with an inlet tube 61 for a metal chloride and an inert gas and an exhaust outlet tube 62. Although these tubes can instead be provided in the retort 10, it is convenient that they be provided in the intermediate connecting section 30.

Each of the tubes 61 and 62 has a valve at a position not so far from the intermediate connecting section 30, and can be cut off from the master conduits on the other side of the valves. In FIG. 1, the tube 61 is a branched tube for introduction of both a metal chloride and an inert gas, wherein each branch tube has a valve.

An inlet tube 39 for the introduction of a sealant 80 is provided above the funnel body 38 of the intermediate connecting section 30. Heating means, usually electric resistance wires 70, 71, are provided on the outside of the intermediate connecting section 30 and the sealant inlet tube 39.

The above-mentioned retort, internal container, cooling container, and condensation cylinder can be made of mild steel or stainless steel.

The retort 10 is received in a suitable heating furnace 90. The heating furnace is suitably heated by an electric resistance heating means. The heating furnace is provided with an opening at the bottom for the outlet duct 15 of the retort 10. No further explanation is given of the heating furnace since this can be easily designed by those skilled in the art.

The heating means 70 for the intermediate connecting section can conveniently be formed of two semi-cylindrical units (if necessary, three units each constituting one-third of a cylinder), which are arranged so as to surround the intermediate connecting section.

Figure 2:
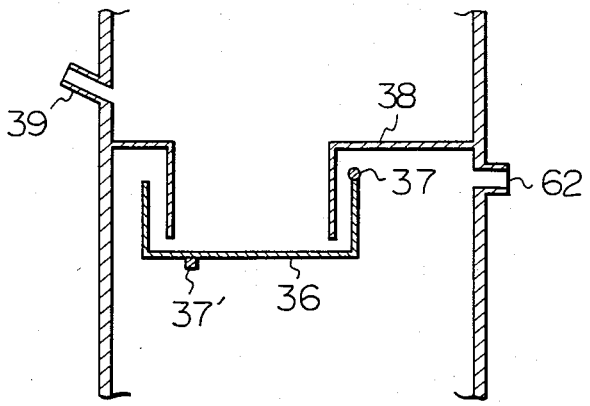
FIG. 2 is an enlarged elevational cross section of the seal pot in accordance with this invention.
Figure 3:
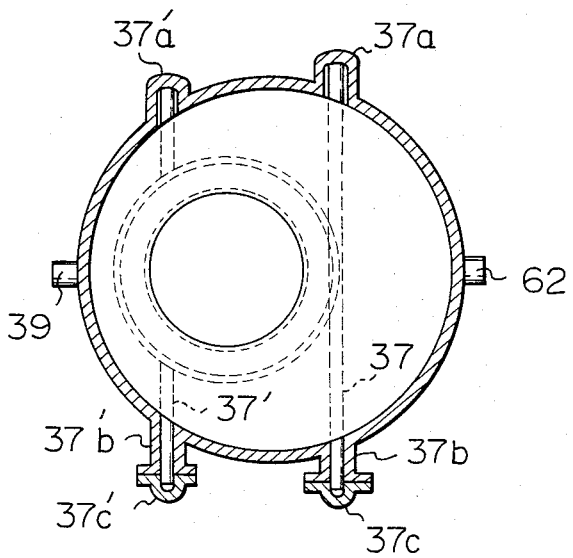
FIG. 3 is a horizontal cross section along line A—A' in FIG. 2.
Figure 4:
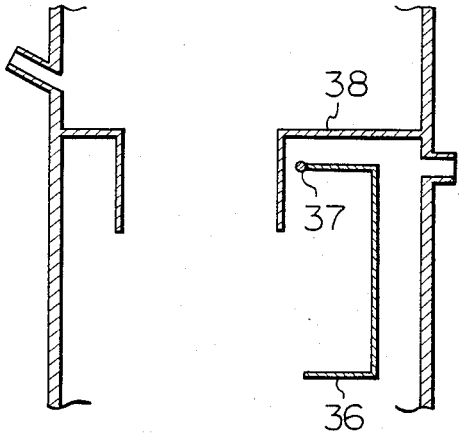
FIG. 4 shows the seal pot of FIGS. 2 and 3 in the open state.

The improved seal pot in accordance with this invention is illustrated in FIGS. 2 and 3 in a somewhat enlarged scale.

As shown in FIG. 2, the funnel body 38 comprises a flat disc and a short cylinder secured to the periphery of a circular opening provided in the disc. However, the shape of the funnel body is not limited to the shape shown in this figure but may be formed as a truncated cone and a pipe as mentioned above, and illustrated in FIG. 1.

The pan 36 is simply a container receiving a sealant, but one end thereof is secured to a rotation shaft 37 and is swingable between a receiving position and a pouring position. The rotation shaft 37 extends across the intermediate connecting section 30 and is hermetically supported in the wall of the latter.

As shown in FIG. 3, one end of the shaft 37 is supported by a blind bearing 37*a* and the other end thereof is supported by a bearing 37*b*, which comprises a short protruding tube 37*b* and a hat-like cap 37*c*. The cap 37*c* is secured to the end of the tube 37*b* with a gasket inserted therebetween by means of bolts or clamps. The gasket may be of a heat resistive resin such as teflon. In certain designs, however, a metal gasket will have to be used.

In order to support the pan 36 at the receiving position, a supporting shaft 37' is used. The bearing means therefor 37*a'*, 37*b'* and 37*c'* are of the same structure as those for the rotation shaft 37. The supporting shaft 37' can, of course, be drawn out until it is detached from the pan. The bearings should be as air-tight as possible (although absolute tightness can not be expected).

Figure 5:
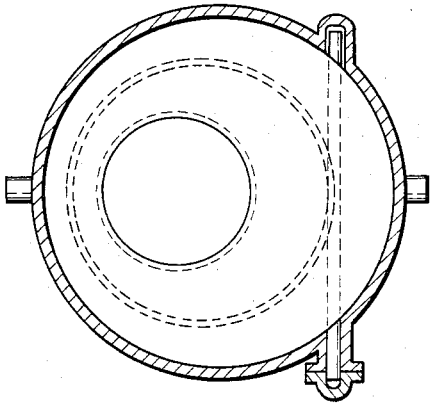
FIG. 5 is an enlarged elevational cross section of another seal pot of this invention.
Figure 6:
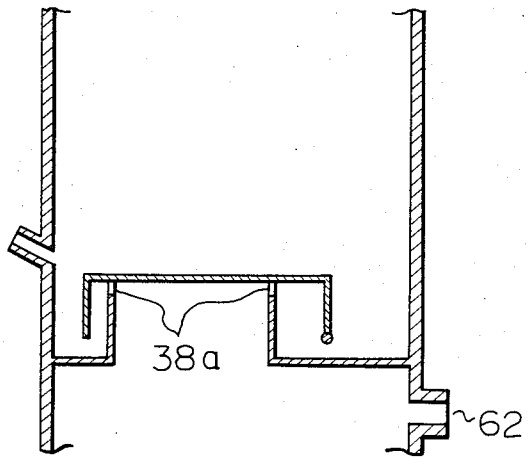
FIG. 6 is a horizontal cross section along line A—A' of FIG. 5.

The structure of another seal pot of this invention is illustrated in FIGS. 5 and 6. The structure in this embodiment is that obtained by inverting the structure shown in FIGS. 2 and 3. In this case, the sealant is received in the upper side of the inverted funnel body, and the pan is merely a lid, which is supported on the funnel body. Therefore, no supporting shaft is required. The funnel body can, of course, be conical.

Preferably a gas leak hole 38*a* is provided. This can be a hole, notch or indentation provided in the wall of the funnel body and facilitates the pouring of a sealant into the receiving space formed by the funnel body.

The operation of the apparatus will now be explained with respect to the apparatus shown in FIGS. 1 and 2–4. After lumps of magnesium are placed in the internal container 20, the flanges 11, 13 and 35 are secured so as to attach the intermediate connecting section 30. Further, the condensation chamber constituted by the cooling container 40 and condensation cylinder 50 is attached and thus the entire apparatus is assembled. The setting of the condensation chamber is made after the reaction chamber (together with the intermediate connecting section) is placed in the heating furnace. The assembled apparatus is tested for gas tightness by evacuation through the outlet 41.

After this test, the pan is set in the receiving position, the apparatus is evacuated through the outlet 41, and an inert gas is introduced into the apparatus through the tube 61 until the inside pressure becomes a little higher than atmospheric pressure. Then a melt of a sealant 80 is introduced into the pan 36 and is allowed solidify. Then the reaction chamber is heated by actuating the heating furnace 90 so as to melt the magnesium lumps, and the reaction is allowed to proceed by introducing a metal chloride through the inlet 61. After the reaction is finished and a sponge metal is formed, the formed magnesium chloride is drained by opening the valve 14 of the duct 15.

Then the valve 14 is closed, and the intermediate connecting section 30 is heated by means of the heating means 70. When the sealant in the pan has melted, the cap 37*c'* of the bearing for the supporting shaft is removed and the supporting shaft is drawn out. Then the sealant is poured out of the pan 36. If necessary, the cap 37*c* of the bearing for the rotation shaft 31 may be removed and the rotation shaft forcibly rotated to completely open the pan 36. The removed cap is fixed again. It is necessary to introduce an inert gas in order to prevent atmospheric air from entering the apparatus.

Thus a large passage is opened between the reaction chamber 10 and the condensation chamber. If heating of the reaction chamber 10 and evacuation of the apparatus are continued, the magnesium chloride entrapped in the formed sponge metal and the unreacted magnesium are vaporized and separated from the metal and are collected in the condensation cylinder 50.

After the evacuation separation is finished, the apparatus is allowed to return to normal pressure by introduction of argon, the caps 37*c* and 37*c'* are removed, the pan is returned to the initial position and supported there by the supporting shaft 37' again. The sealant 80 is again introduced and solidified. The condensation chamber is removed from the intermediate connecting section 30 and the reaction chamber 10 (together with the intermediate connecting section 30) is taken out of the heating furnace 90. After the reaction chamber 10 is cooled, the formed sponge metal is taken out. Thus one batch run is finished.

The passage of the intermediate connecting 30 section is already closed. Therefore, for the next run, the reaction can be immediately started after magnesium is placed in the reaction chamber 10 and the apparatus is assembled.

The operation is the same for the apparatus shown in FIGS. 5 and 6. But in this case, there is no supporting shaft and the rotation shaft must be forcibly rotated.

EXAMPLE 1

An apparatus as shown in FIG. 1 having the seal pot of the structure shown in FIGS. 2 and 3 was constructed. The dimensions were as follows.

Both the retort and the cooling container were of the bell shape 700 mm in outside diameter and 1760 mm in height. The cylindrical part of the intermediate connecting section was 370 mm in height and 185 mm in inside diameter.

The retort and the intermediate connecting section (including the seal pot) were made of ferritic stainless steel. The retort and the intermediate connecting section were made of 25 mm thick plates and the seal pot was made of 5 mm thick plates. The seal pot was 108 mm in outside diameter and 40 mm in height. The funnel body was 68 mm in outside diameter and 52 mm in height. The condensation container and the condensation cylinder were made of mild steel. The internal container of the reaction chamber was also made of mild steel.

EXAMPLE 2

An apparatus substantially as shown in FIG. 1 having a seal pot of the structure shown in FIGS. 5 and 6 was constructed. The dimensions were the same as those of Example 1.

The retort and the intermediate connecting section (including the seal pot) were made of ferritic stainless steel. The retort, the internal container of the reaction chamber and the intermediate connecting section, which are subjected to heating, were 25 mm in thickness and the seal pot was made of 5 mm thick plate. The cylindrical part of the funnel body was 80 mm in diameter and was spaced from one side of the wall of the intermediate connecting section by 75 mm and spaced from the other side of the wall by 30 mm when measured on the diameter. The height of the cylindrical part was 40 mm. The depth of the pan was 34 mm and the diameter thereof was 138 mm.

OPERATION EXAMPLE 1

Following the above-described operation procedures, titanium was prepared. First, 371 kg of solid magnesium was placed in the internal container of the reaction chamber, and argon was introduced into the apparatus so that the internal pressure was a little higher than atmospheric pressure. The passage of the intermediate connecting section was closed by introducing molten metallic magnesium into the pan, and the retort was heated at 800° C. so as to melt the charged magnesium. Then about 1000 kg of titanium chloride was introduced dropwise into the reaction chamber allowing reaction to proceed with care not to allow the temperature to rise too much. After the reaction was finished, the apparatus was repressurized with argon and the formed magnesium chloride was drained. The seal pot was heated and the pan was opened as explained above. The molten magnesium sealant dropped into the reaction chamber.

The reaction chamber was heated up to 1000° C., whereafter evacuation separation was started and continued for 30 hours. The evacuation was very smoothly effected.

The seal pot was again closed, molten magnesium was introduced into the seal pot and solidified, the condensation chamber was removed, and the reaction chamber (together with the intermediate connecting section) was taken out of the heating furnace. After cooling, 245 kg of sponge titanium was taken out.

OPERATION EXAMPLE 2

Using the apparatus of Example 2, 243 kg of sponge titanium was obtained by the same operation as in Operation Example 2.

We claim:

1. In a hermetically closable and evacuable apparatus for preparing high melting point high toughness metals by reduction of a chloride of said metals comprising a heatable reaction chamber and a coolable condensation chamber provided above the reaction chamber and communicating with the condensation chamber through an intermediate connecting section, the improved apparatus characterized in that said intermediate connecting section is provided with a seal pot closing means comprising an upright funnel body which has an opening of a substantial size and is supported by the internal wall of the intermediate connecting section at its periphery; a pan which can receive a fusible material therein and is pivotable around a rotation shaft secured thereto at one end thereof between a receiving position and a pouring position and receives the lower pipe of the funnel body when it is at the receiving position; and a heating means for heating the seal pot.

2. The apparatus as claimed in claim 1, wherein the intermediate connecting section is a cylindrical body; the rotation shaft extends across the intermediate connecting section; one end of said shaft is supported by a blind bearing provided in the wall of the intermediate connecting section; the other end thereof is supported by a bearing which comprises a short tube penetrating the wall of the intermediate connecting section and a cap detachably secured to the end of the tube by a bolt or clamp means; and the pan can be retained at the receiving position by means of a shaft extending across the intermediate connecting section supported by a blind bearing and a bearing which comprises a short tube penetrating the wall of the intermediate connecting section and a cap detachably secured to the end of the tube by clamp means.

3. The apparatus as claimed in claim 1, wherein the funnel body comprises a truncated cone and a cylinder of a substantial cross-sectional area connected to the truncated end of the cone.

4. The apparatus as claimed in claim 1, wherein the funnel body comprises an annular plate and a cylinder of a substantial cross-sectional area connected to the aperture of the annular plate.

5. In a hermetically closable and evacuable apparatus for preparing high melting point high toughness metal by reduction of a chloride of said metals comprising a heatable reaction chamber and a coolable condensation chamber provided above the reaction chamber and communicating with the condensation chamber through an intermediate connecting section, the improved apparatus characterized in that said intermediate connecting section is provided with a seal pot closing means comprising an inverted funnel body which has an opening of a substantial size and is supported by the internal wall of the intermediate connecting section at its periphery, and can receive a fusible material in the space formed by the funnel and the internal wall of the intermediate connecting section; a pan which covers the opening of the funnel and is pivotable around a rotation shaft secured thereto at one end thereof; and a heating means for heating the seal pot.

6. The apparatus as claimed in claim 5, wherein the intermediate connecting section is a cylindrical body; the rotation shaft extends across the intermediate connecting section; one end of said shaft is supported by a blind bearing provided in the wall of the intermediate connecting section; the other end thereof is supported by a bearing which comprises a short tube penetrating the wall of the intermediate connecting section and a cap detachably secured to the end of tube by means of bolt or clamp means; and the pan can be opened by forcibly rotating the rotation shaft thereof which extends outside of the intermediate connecting section.

7. The apparatus as claimed in claim 5, wherein the funnel body comprises a truncated cone and a short upward-extending cylinder of a substantial cross-sectional area connected to the truncated end of the cone.

8. The apparatus as claimed in claim 5, wherein the funnel body comprises an annular plate and a short upward-extending cylinder of a substantial cross-sectional area connected to the aperture of the annular plate.

9. The apparatus as claimed in claim 5, wherein the edge of the opening of the funnel body has a gas leak hole.

10. The apparatus as claimed in claim 9, wherein the gas leak hole is an indentation.

* * * * *